US005110301A

United States Patent [19]

Inoue et al.

[11] Patent Number: 5,110,301

[45] Date of Patent: May 5, 1992

[54] MULTI-WAY CONNECTOR REQUIRING LESS INSERTING FORCE

[75] Inventors: Nori Inoue; Masamitsu Chishima, both of Yokkaichi, Japan

[73] Assignee: Sumitomo Wiring System Ltd.

[21] Appl. No.: 629,592

[22] Filed: Dec. 18, 1990

[30] Foreign Application Priority Data

| | | | |
|---|---|---|---|
| Dec. 22, 1989 | [JP] | Japan | 1-333238 |
| Feb. 9, 1990 | [JP] | Japan | 2-12397[U] |
| Mar. 7, 1990 | [JP] | Japan | 2-23078[U] |

[51] Int. Cl.[5] ..... H01R 13/62

[52] U.S. Cl. ..... 439/310; 74/89.18; 403/322; 439/157

[58] Field of Search ..... 74/89.18; 285/314; 403/314, 361, 322; 439/153, 157, 160, 310, 362, 364, 374

[56] References Cited

U.S. PATENT DOCUMENTS

| | | | |
|---|---|---|---|
| 3,453,586 | 7/1969 | Brendlen, Jr. | 439/153 |
| 3,756,088 | 9/1973 | Inoue | 74/89.18 X |
| 4,045,109 | 8/1977 | Langenbach et al. . | |
| 4,152,038 | 5/1979 | Inouye et al. | 439/157 X |
| 4,804,335 | 2/1989 | Pennington | 439/377 X |
| 4,875,873 | 10/1989 | Ishizuka et al. | 439/157 X |

FOREIGN PATENT DOCUMENTS

| | | | |
|---|---|---|---|
| 0273999 | 7/1988 | European Pat. Off. | 439/160 |
| 2833624 | 3/1979 | Fed. Rep. of Germany | 439/310 |

*Primary Examiner*—Neil Abrams
*Assistant Examiner*—Khiem Nguyen

[57] ABSTRACT

In a multi-way connector requiring less inserting force in which the front portions of a pair of female and male connector housings each accommodating groups of ternminals are fitted in each other so as to be coupled together for connection, a rotatable member rotatablv supported and having a driver point projection and a follower point pawl that are formed on the outer circumference thereof is provided in one of the pair of connector housings, while a driver slide is mounted on the upper side of the rotatable member. The driver slide is slidable in a coupling direction of the connector housing, and the leading end of the driver slide is brought into abutment with the rear of the driver point projection with the rear end thereof being allowed to project from the connector housing in which it is provide. In addition, a follower engagement portion designed to be brought into engagement with the follower point pawl is provided in the other connector housing of the pair of connector housings, whereby the pair of connector housings are coupled together for connection by the action of the rotatable member resulting when the driver slide is pushed in.

6 Claims, 12 Drawing Sheets

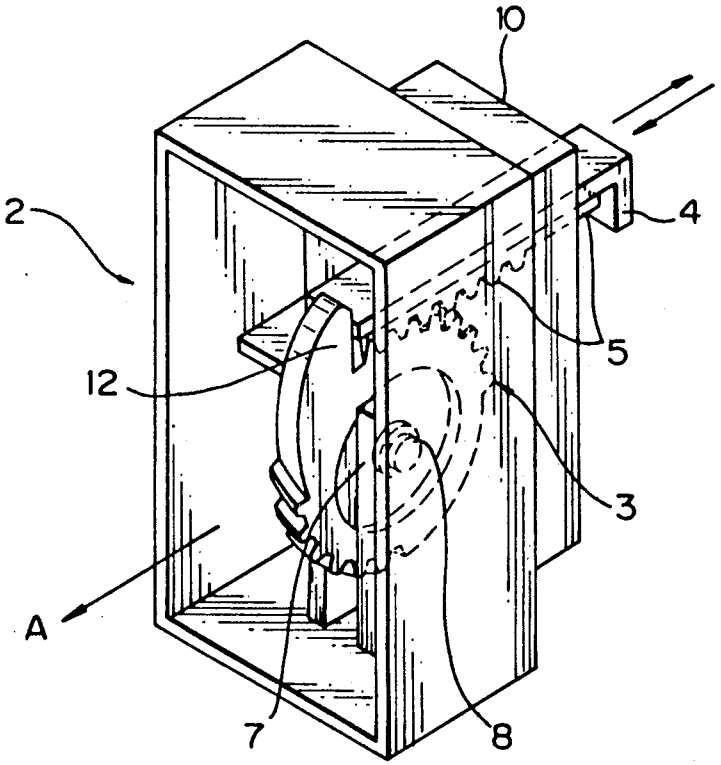
Fig.4(A)
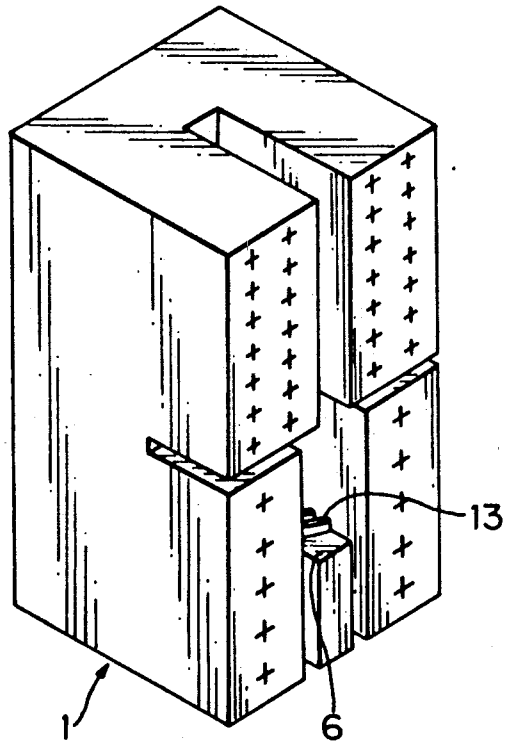

MULTI-WAY CONNECTOR REQUIRING LESS INSERTING FORCE

BACKGROUND OF THE INVENTION

1. Field of the Invention

The present invention relates to a multi-way connector requiring less inserting force in which a female connector housing accommodating a multitude of terminals and a male connector housing also accommodating a multitude of terminals are able to be coupled together for connection with a small magnitude of force.

2. Statement of the Prior Art

In keeping with the increase of the number of electric components and sophistication of electric circuits used in automotive vehicles, more and more multi-way connectors are used for connection of electric circuits of automotive vehicles. When connecting together multi-way connectors each accommodating a multitude of groups of terminals, connection resistance between the contact portions of the groups of terminals grows, and therefore a great magnitude of inserting force is required to connect together such multi-way connectors.

With a view to solving this problem, the official gazette of Japanese Utility Model Laid-Open No. 99788/1988 discloses a connector requiring less inserting force as a means for reducing inserting force required to couple together multi-way connectors of the above type.

Specifically speaking, in this connector requiring less inserting force, a rotatable lever provided with a pinion on the outer circumference of the supporting portion thereof is mounted on one of female and male connector housings that are to be coupled together, while a rack designed to be brought into mesh with the pinion is provided on the other. In this construction, when the rotatable lever is rotated in the direction different from one in which the connector housing is coupled to the other, coupling force is amplified, and this enables the female and male connector housings to be coupled together with a small magnitude of force.

In this known multi-way connector requiring less inserting force, inserting force is amplified by the rotatable lever serving as a lever body, and an inserting operation with less force is actually realized to a certain extent. However, the rotational direction of the rotatable lever is different from the direction in which the connector housing is coupled to the other, and moreover a coupling operation of a pair of connector housings is performed in such a manner that the pair of connector housings are held in a temporary fitted state, and that the rotatable lever is then rotated to operate in the direction different from the coupling direction to thereby enable the pair of connector housings to be coupled together. This often requires the operator to shift his/her hand from one position to another, leading to a drawback that the operating efficiency in coupling two connector housings is reduced to a great extent.

In addition, a certain amount of space is required around the connector so that the rotatable lever can be rotated, and therefore this leads to another drawback that the connector requiring such space therearound is not suitable for use in automotive vehicles in which only a limited space is allowed around an electric wiring connector.

SUMMARY OF THE INVENTION

An object of the present invention is to provide a multi-way connector requiring less inserting force that has good operating efficiency.

Another object of the present invention is to provide a multi-way connector requiring less inserting force that is suitable for use in establishing electric wiring in automotive vehicles or the like in which only a limited space is allowed therearound.

A further object of the present invention is to provide a multi-way connector requiring less inserting force in which a gear mechanism is employed, whereby high reliability in operation and suitable utility are attained.

With a view to accomplishing the above objects, a multi-way connector requiring less inserting force according to the present invention in which the front half portions of a pair of female and male connector housings each accommodating groups of terminals are temporarily fitted in each other so as to be coupled together for connection is constructed such that a pinion rotatable supported and a slide rack intended to be brought into mesh with the pinion and to rotate in the direction in which the connector housing is coupled to the other are provided in one of the female and male connector housings with the rear end of the slide rack projecting rearwardly of the connector housing, while a fixed rack portion on which the pinion is designed to roll in a meshing fashion is provided in the other connector housing, whereby the slide rack is caused to slide so as to enable the pair of connector housings to be coupled together for connection.

Either a spur gear or a helical gear may be used for the above pinion and two racks.

Furthermore, with a view to accomplishing the above objects, a multi-way connector requiring less inserting force according to the present invention in which the front half portions of a pair of female and male connector housings each accommodating groups of terminals are temporarily fitted in each other so as to be coupled together for connection is constructed such that a rotatable cam rotatably supported and having a driver point projection and a follower point pawl formed in the outer circumference thereof is provided in one of the female and male connector housings with a driver slide designed not only to slide in the direction in which the connector housings are coupled together but also to be brought into abutment with the rear of the driver point projection at the front end thereof being mounted on the upper side of the rotatable cam with the rear end thereof projecting rearwardly of the connector housing, while a follower engagement portion designed to be brought into engagement with the follower point pawl is provided in the other connector housing with the rotative radius ratio relationship between the driver point projection and the follower point pawl being set such that the rotative radius of the former is equal to or greater than the rotative radius of the latter, whereby the rotatable cam is rotated by pushing the driver slide inwardly so as to draw the follower engagement portion that is in engagement with the follower point pawl nearer, thereby enabling the pair of connector housings to be coupled together with great magnitude of force.

In the multi-way connector requiring less inserting force according to the present invention that is constructed as described above, when the slide rack projecting rearwardly of one of a pair of female and male connector housings that are confronted to each other is pushed in, the pinion that is in mesh with the slide rack is rotated by virtue of the sliding movement of the slide rack, and is then brought into mesh with the fixed rack portion provided in the other connector housings so as to roll thereon in a meshing fashion. Thus, the pair of connector housings are moved in their coupling directions to approach each other by virtue of the sliding force by the slide rack.

During this approaching operation, the slide rack and the fixed rack portion are brought into mesh with the sides of the pinion that is formed as a single unit, respectively, and the pinion rolls to move on the fixed rack portion. This allows the pinion, the fixed rack portion, and the slide rack to function as a movable pulley with a single rope wound therearound, a portion of the rope wound around the movable pulley that is on the fixed end side, and a portion of the rope wound around the movable pulley that is on the take-up side, respectively, wherein sliding force applied to the slide rack is amplified to be transferred as advancing force for the pinion, this generating a great magnitude of coupling force acting on the pair of connector housings, thus making it possible to couple the connector housings together with less inserting force.

Moreover, the coupling with less inserting force of this type is accomplished only by pushing in the slide rack in the direction in which the connector housing is coupled to the other, and this enables a coupling operation to be performed in an extremely easy way and obviates the necessity of special operating space around the connector.

Furthermore, in the multi-way connector requiring less inserting force according to the present invention, when the driver slide projecting rearwardly of one of a pair of female and male connector housings that are confronted to each other to be temporarily coupled together (in a state in which the fitting portions of the female and male connector housings are slightly fitted in each other with terminals in the connector housings not yet being connected to each other) is pushed in, the rotatable cam is rotated by virtue of the sliding movement of the driver slide, and the follower engagement portion provided in the other connector housing is brought into engagement with the follower point pawl of the rotatable cam, whereby the pair of connector housings are moved in their coupling directions to approach each other.

During this approaching operation, the driver slide and the follower engagement portion are brought into engagement, respectively, with the driver point projection and the follower point pawl both formed on the outer circumference of the rotatable cam that is formed as a single unit to thereby rotate the rotatable cam, while the rotatable cam itself moves relatively to the other connector housing so as to approach the same. This allows the rotatable cam, the driver slide and the portion of the other connector housing in which the follower engagement portion is provided to function as a movable pulley with a single rope wound therearound, a portion of the rope wound around the movable pulley that is on the take-up side, a portion of the rope wound around the movable pulley that is on the fixed end side, respectively, wherein sliding force applied to the driver slide is amplified to be transferred as advancing force for the rotatable cam, this generating a great magnitude of coupling force acting on the pair of connector housings, thus making it possible to couple the connector housings together with less inserting force.

Further, the coupling with less inserting force of this type is accomplished only by pushing in the driver slide in the direction in which the connector housing is coupled to the other, and this enables a multi-way connector to be coupled with less inserting force and in an extremely easy way, and obviates the necessity of special operating space around the connector.

BRIEF DESCRIPTION OF THE DRAWINGS

FIGS. 1(A)–1(C) show a first embodiment of a multi-way connector requiring less inserting force according to the present invention, wherein FIG. 1(A) is a perspective view thereof, FIG. 1(B) is an exploded perspective view of constituent members thereof, and FIG. 1(C) is a front view thereof;

FIGS. 4(A)–4(C) a third embodiment of the multi-way connector requiring less inserting force according to the present invention, wherein FIG. 4(A) is a perspective view thereof, FIG. 4(B) is an exploded perspective view showing constituent members thereof, and FIG. 4(C) is a bottom view of a slide rack used therein;

FIGS. 5(A)–5(C) shows a fourth embodiment of the multi-way connector requiring less inserting force according to the present invention, wherein FIG. 5(A) is a perspective view thereof, FIG. 5(B) is a front view thereof, and FIG. 5(C) is an exploded perspective view showing constituent members thereof;

DETAILED DESCRIPTION OF THE PREFERRED EMBODIMENTS

Figure 1A:
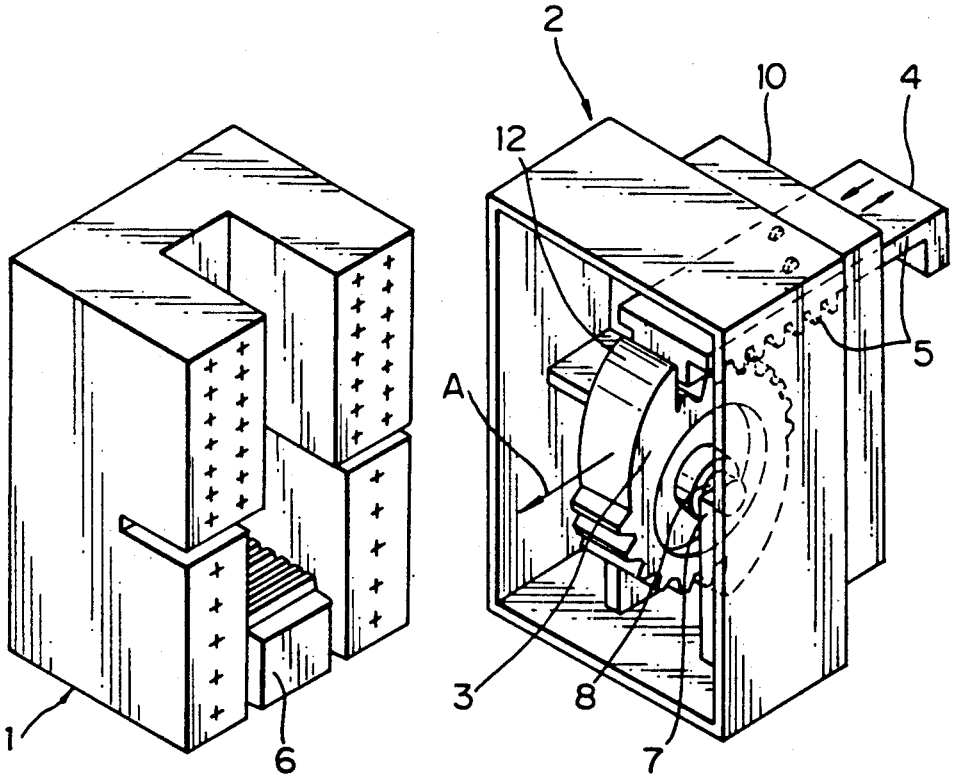
Figure 1C:
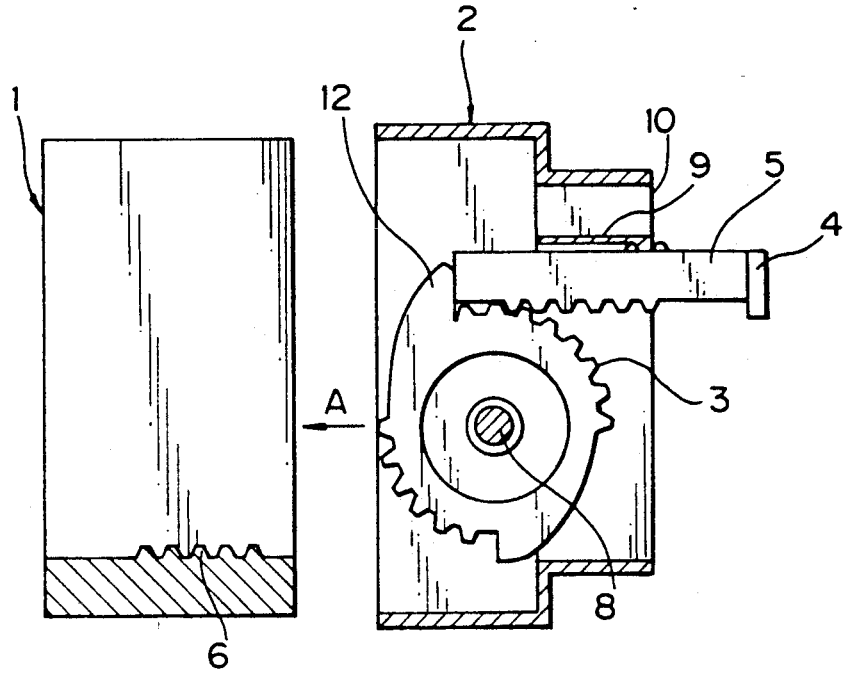

Referring to FIGS. 1 and 2 in which a first embodiment of the present invention is shown, in a multi-way connector in which the front half portions of a female connector housing 1 accommodating groups of female terminals 1*a* and a male connector housing 2 accommodating groups of male terminals 2*a* are fitted in each other so as to be coupled together for connection, a spur gear type pinion 3 is rotatably supported inside the male connector housing 2, and a slide rack 5 is provided such that the slide rack 5 is brought into mesh with the upper side of the pinion 3 with its rear end 4 projecting from a rear wall 10 of the connector housing and that it slides in the same direction as the coupling direction (as shown by arrow A) of the connector housing. A fixed rack portion 6 is integrally formed in the female connector housing 1 such that the fixed rack portion 6 is brought into mesh with the lower side of the pinion 3 when the female and male connector housings are confronted to each other so as to take a fitting posture, and the pinion 3 and the fixed rack portion 6 are arranged in the respective connector housings so as to face the front openings of the confronting connector housings.

Figure 1B:
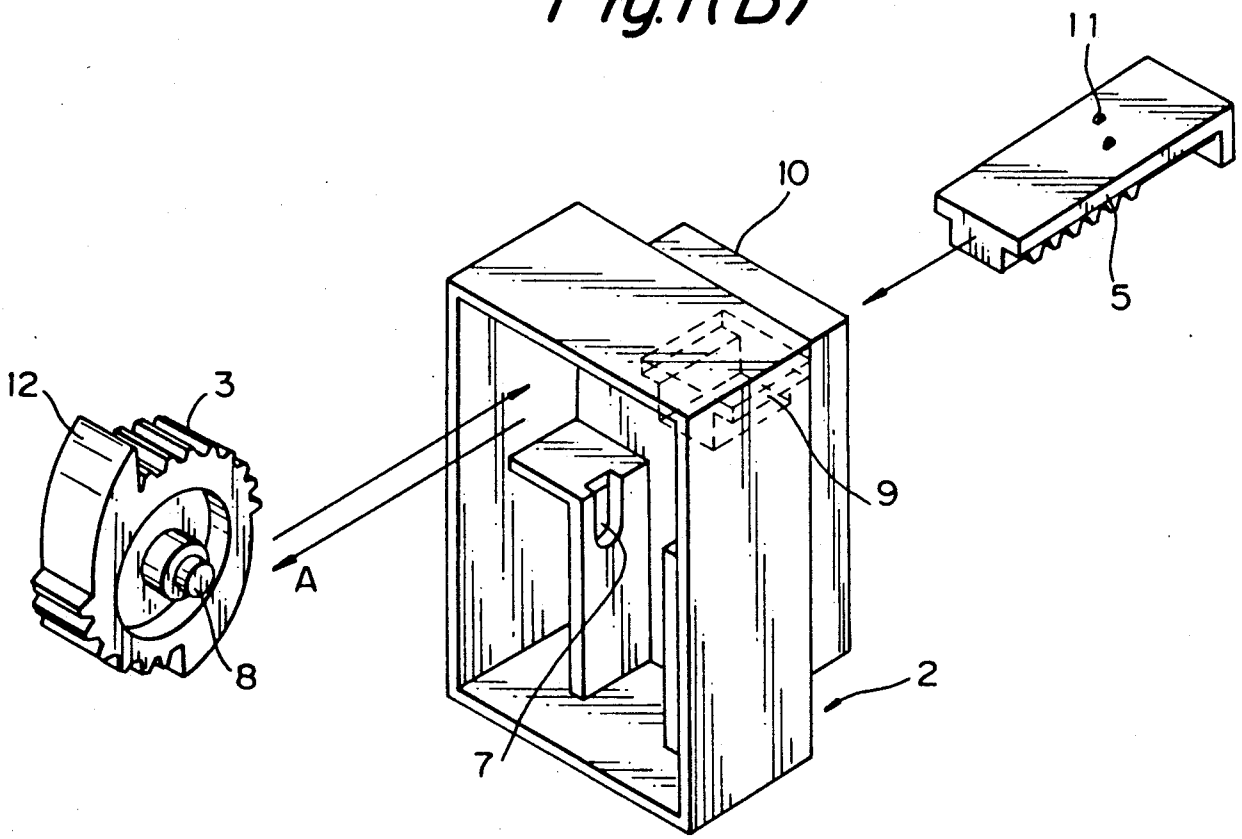

To explain in detail, referring to FIG. 1(B), the pinion 3 and the slide rack 5 are individual bodies and are formed from resin as in the case of the male connector housing 2. The pinion 3 is rotatably supported on a support portion 7 provided in the central cavity portion of the male connector housing 2, and its support shaft 8 is supported in the direction normal to the coupling direction A. The slide rack 5 is inserted into a slide groove 9 formed in an upper position of the central cavity portion from the rear so as to slide on the upper side of the pinion 3 in a meshing fashion in the same direction as the coupling direction A. The rear end 4 of the slide rack 5 projects from the rear wall 10 of the connector housing when the slide rack 5 is located at a slide rear dead point, and a distance by which the rear end 4 projects from the rear wall 10 substantially equals a necessary slide stroke.

Figure 2C:
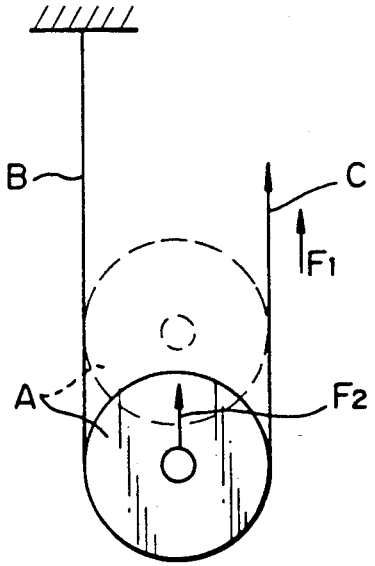
FIG. 2(C) is an explanatory view showing the operational principle of the first embodiment of FIG. 1.
Figure 2A:
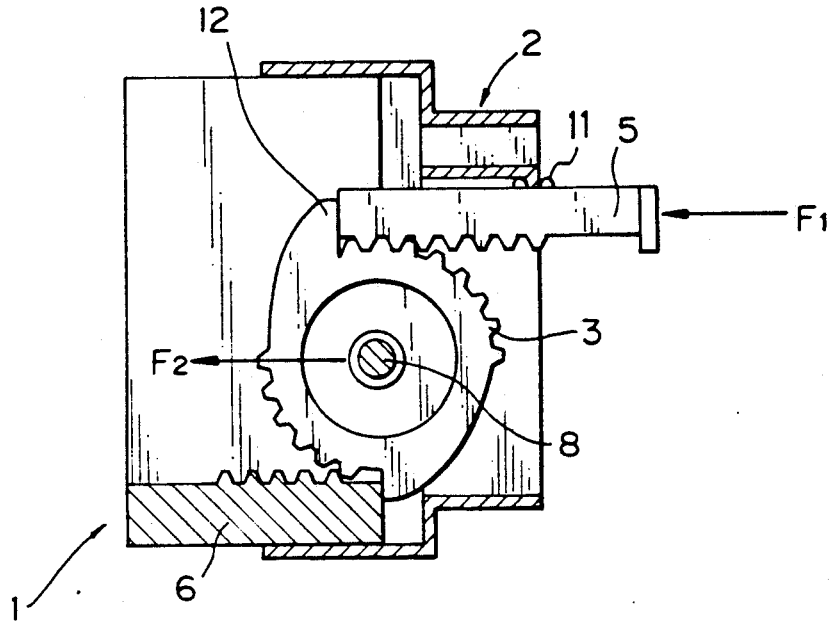
FIGS. 2(A) and 2(B) are front views showing a state in which the first embodiment shown in FIG. 1 is being operated.
Figure 2B:
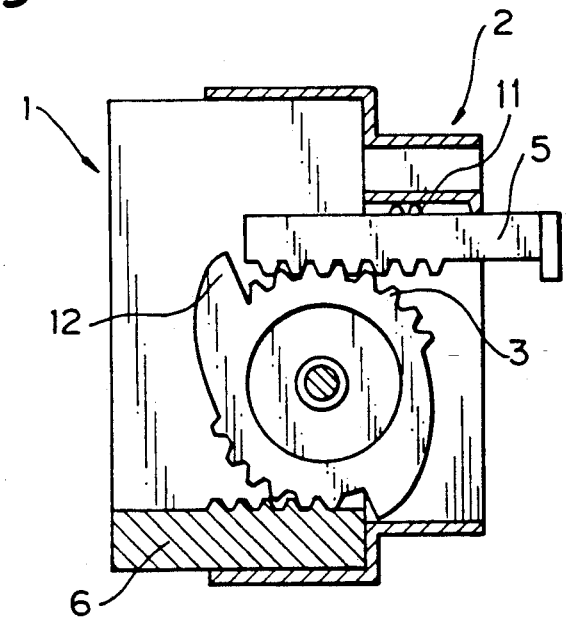

Referring to FIG. 2, when the female and male connector housings 1, 2 are, as shown in FIG. 2(A), confronted to and are temporarily fitted in each other (in a state in which only the leading end portions of the female and male connector housings are inserted in each other with the female and male terminals therein not yet being fitted in each other), the pinion 3 comes into mesh with the front end of the fixed rack portion 6. Following this, when the slide rack 5 is pushed in by the tip of the finger, it starts to slide, and the pinion 3, which is already in mesh with the fixed rack portion 6, then starts to rotate so as to roll in a meshing fashion on the fixed rack portion 6. This imparts advancing force $F_2$ to the pinion 3, and the slide rack 5 as shown in FIG. 2(B), continues to be pushed in until it reaches a front dead point, where the female and male connector housings 1, 2 are coupled together in a normal posture. In the drawing, reference numeral 11 denotes a locking projection intended to be brought into engagement with a locking portion in the connector housing 2 so as to prevent the withdrawal of the slide rack 5 when the slide rack 5 is forced into the front dead point.

In addition, in this embodiment, formed on the outer circumference of the pinion 3 is a positioning projection 12 with which the front end of the slide rack 5 is brought into abutment when the slide rack 5 is located at the rear dead point.

According to the above embodiment shown in FIG. 1, the pinion 3, the fixed rack portion 6, and the slide rack 5 function, as shown in FIG. 2(C), as a movable pulley A with a single rope wound therearound, a portion B of the rope wound around the movable pulley that is on the fixed end side, and a portion C of the rope wound around the movable pulley that is on the take-up side, respectively, and since these pinion 3, fixed rack portion 6 and slide rack 5 constitute together a movable pulley mechanism with a single rope wound therearound, when sliding force $F_1$ (taking-up force $F_1$ by the rope of the above movable pulley mechanism) is applied to the slide rack 5, great magnitude of advancing force $F_2$ (lifting-up $F_2$ by the movable pulley A of the above movable pulley mechanism) is generated on the pinion 3. This creates a relationship of $F_2=2F_1$ (a theoretical value), and thus the female and male connector housings 1, 2 are coupled together for connection with a small magnitude of inserting force in an accurate manner.

In addition, since the above coupling and connecting operation is accomplished only by pushing in the slide rack 5 projecting rearwardly of the connector housing in the direction in which the connector housing is to be coupled to the other, the pair of connector housings are able to snap into place in a simple and accurate manner only using the tip of the finger of one of the hands, and no special operation space is required. Thus, the multi-way connector of the present invention improves the operation efficiency of multi-way connectors for use in automotive vehicles in which a simple and accurate coupling operation needs to be performed in a limited space to a great extent.

Moreover, in this embodiment, since the positioning projection 12 is formed on the pinion 3, when the slide rack 5 and the pinion 3 are brought into mesh with each other, the two members are able to be put in a normal meshing position in a simple and accurate manner only by pushing in the slide rack 5 with its leading end being in abutment with the positioning projection 12 of the pinion 3. Thus, the female and male connector housings 1, 2 are coupled together with the above advancing force $F_2$ in an extremely easy fashion.

Next, referring to FIG. 3, a second embodiment of the present invention will now be described. This second embodiment shows a mode of operation intended to further improve the less inserting force action described in the first embodiment, wherein the pinion 3 comprises a large diameter pinion portion 3A having a radius $R_1$ and a small diameter pinion portion 3B having a radius $R_2$ that are integrally formed on the same rotating shaft 8, the former being designed to be brought into mesh with the slide rack 5, the latter with the fixed rack portion 6.

Figure 3A:
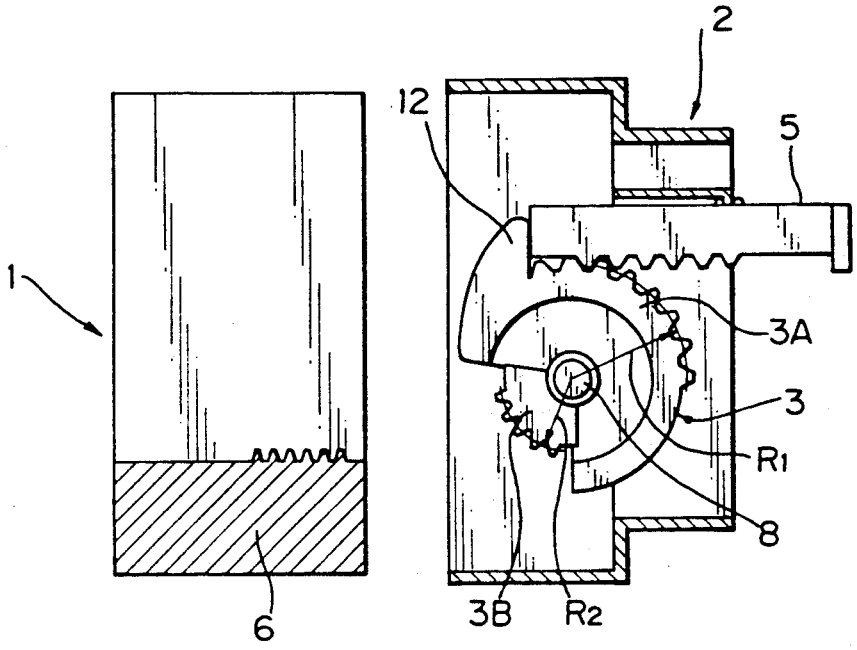
FIGS. 3(A) and 3(B) are front views showing a second embodiment of the multi-way connector requiring less inserting force according to the present invention.
Figure 3B:
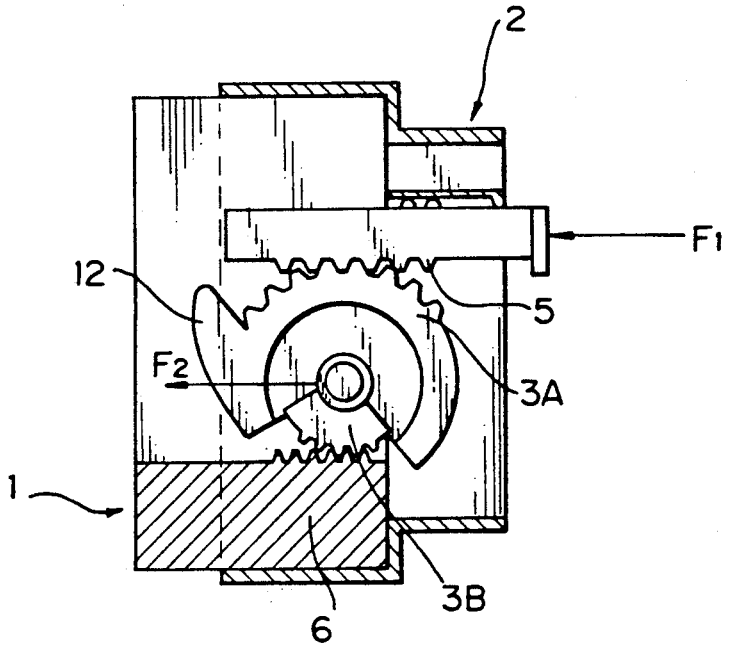

According to this embodiment shown in FIG. 3, the advancing distance of the pinion 3 relative to the sliding distance of the slide rack 5 is reduced compared with one in the first embodiment. However, the advancing force $F_2$ of the pinion 3 is further amplified due to the above radius ratio relationship of $R_1$:$R_2$—in a case where the radius ratio relationship of $R_1$:$R_2$ is 2:1, $F_1$ and $F_2$ fall in a relationship of $F_2=3F_1$, and this enables the female and male connector housings 1, 2 to be coupled together for connection with further less inserting force.

Figure 4C:
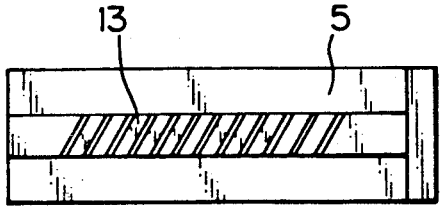
Figure 4B:
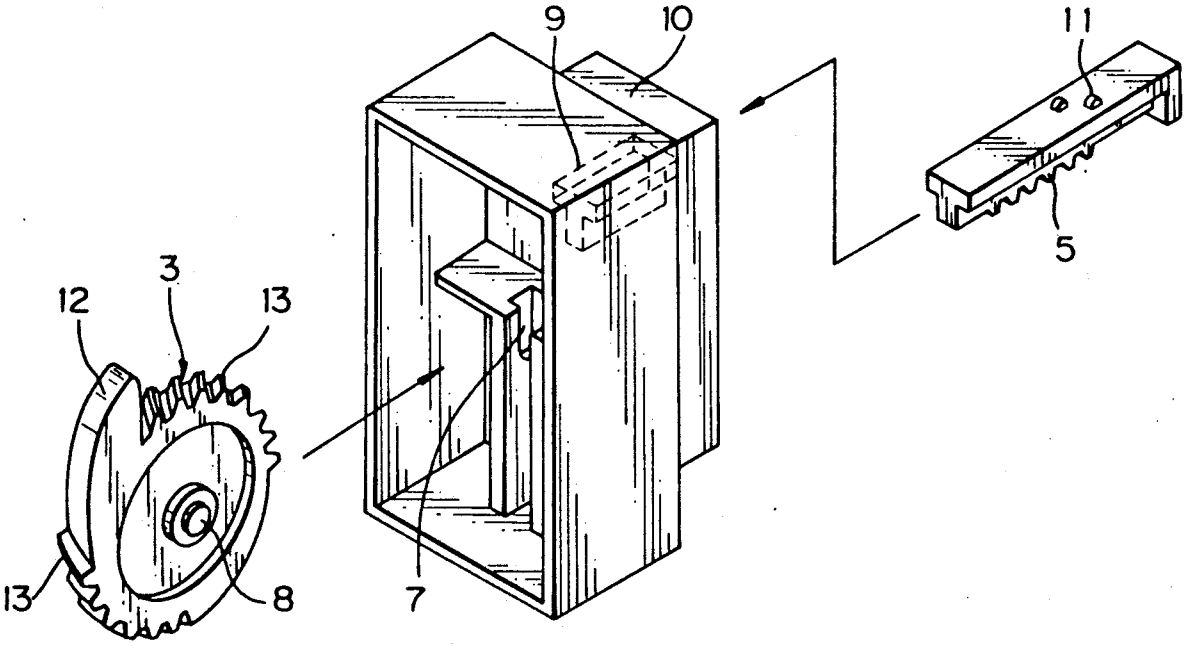

Referring to FIGS. 4(A), 4(B) and 4(C), a third embodiment of the present invention will be described below. In this third embodiment, helical gears are provided on the pinion 3, slide rack 5 and fixed rack portion 6, and the other factors of the construction of the embodiment are substantially the same as those of the first and second embodiments.

In the embodiment of the multi-way connector requiring less inserting force shown in FIG. 4, the pinion 3 intended to transfer the above-mentioned advancing force $F_2$ comprises a helical gear, and the slide rack 5 and the fixed rack portion 6 comprise helical teeth that are brought into mesh with the pinion 3. Due to this construction, in a case where the same module is used in helical and spur gears, the effective tooth width (a sectional tooth width in the rotating direction) of the former becomes greater than that of the latter in proportion to the angle of inclination of a helical tooth used, and this serves to improve the degree of transmission of force.

Therefore, when trying to obtain the same advancing force $F_2$ as that to be obtained with the spur gear construction, the width of the pinion 3, the slide rack 5 and the fixed rack portion 6 may be made smaller than that of the relevant members used with the spur gear construction. Thus, the third embodiment is advantageous in that the connector can be coupled for connection with less inserting force, while meeting the industrial requirements for smaller and lighter connectors.

Also in the second embodiment of the present invention that has already been described above with reference to FIG. 3, as in the case of the third embodiment, the pinion 3 is a helical gear as shown in FIG. 4(C) with a view to further improving the less inserting force action, and comprises a large diameter pinion portion 3A having a radius $R_1$ and a small diameter pinion portion 3B having a radius $R_2$ that are integrally formed on the same rotating shaft 8, the former being designed to be brought into mesh with the slide rack 5 having helical teeth 13, the latter with the fixed rack portion 6 having helical teeth 13.

Figure 5A:
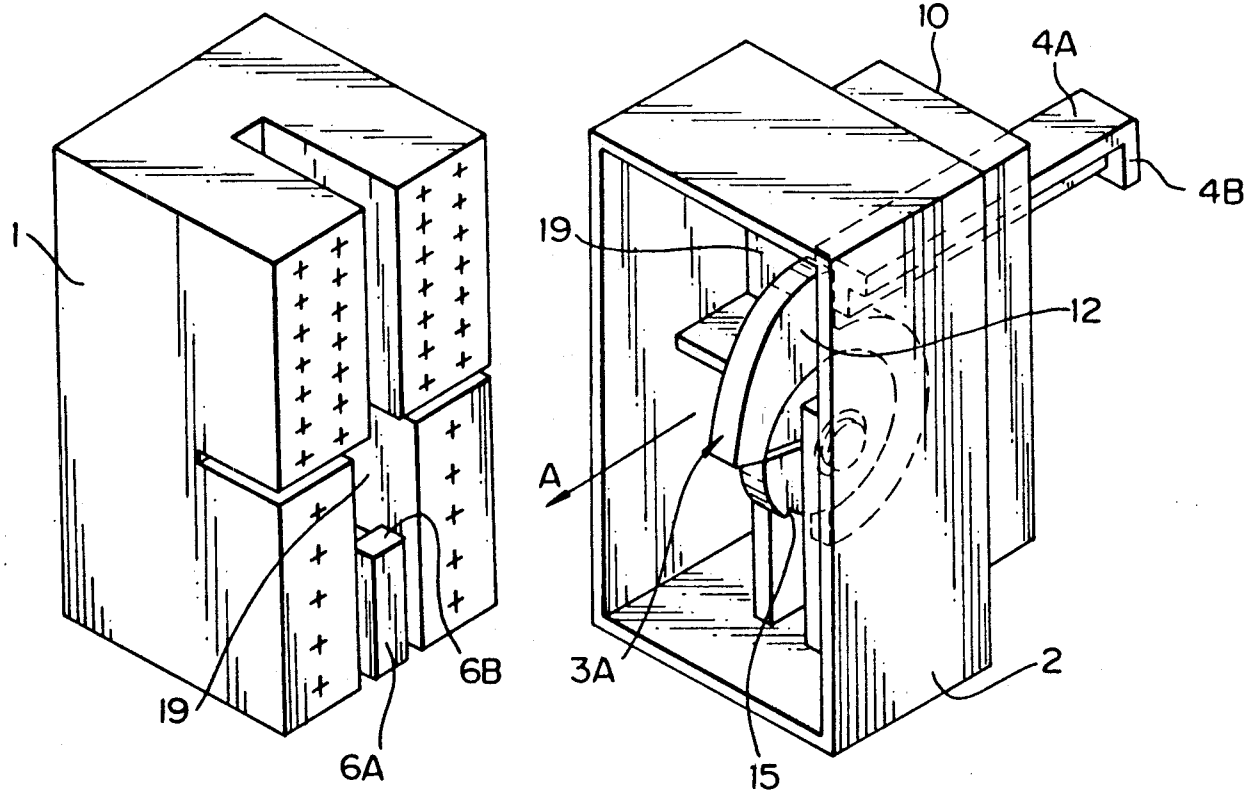
Figure 5B:
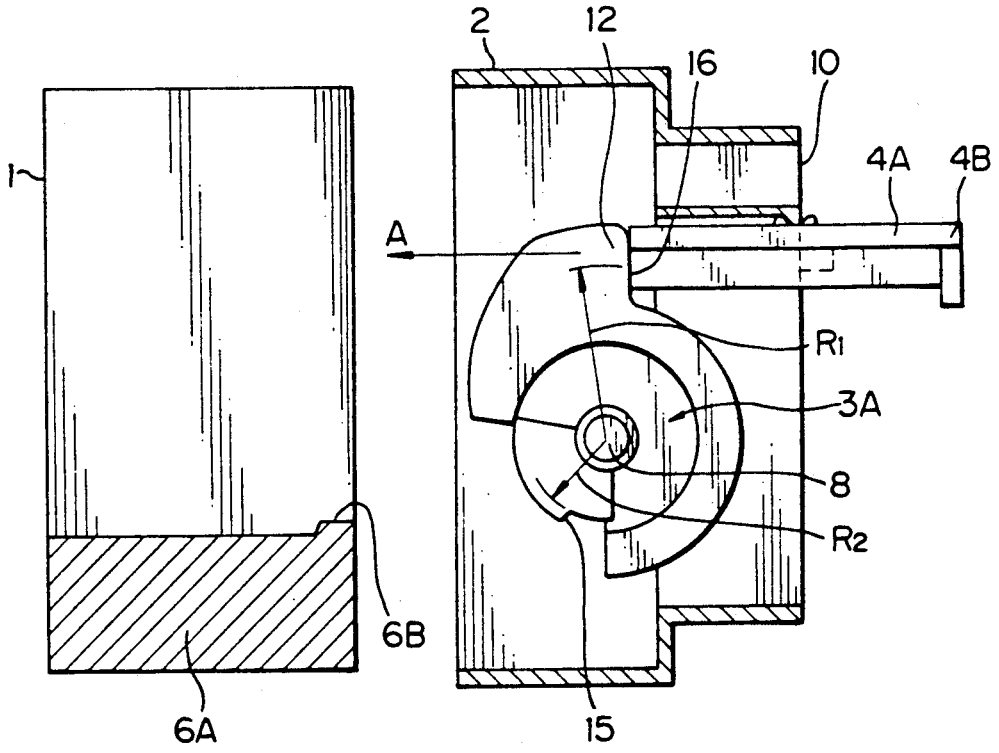
Figure 6D:
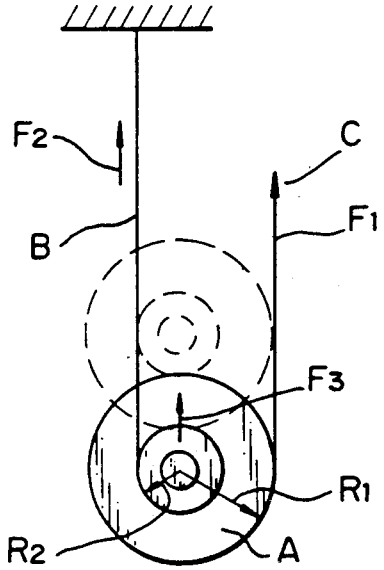
FIG. 6(D) is an explanatory view showing the operational principle of the embodiment shown in FIG. 5.
Figure 6A:
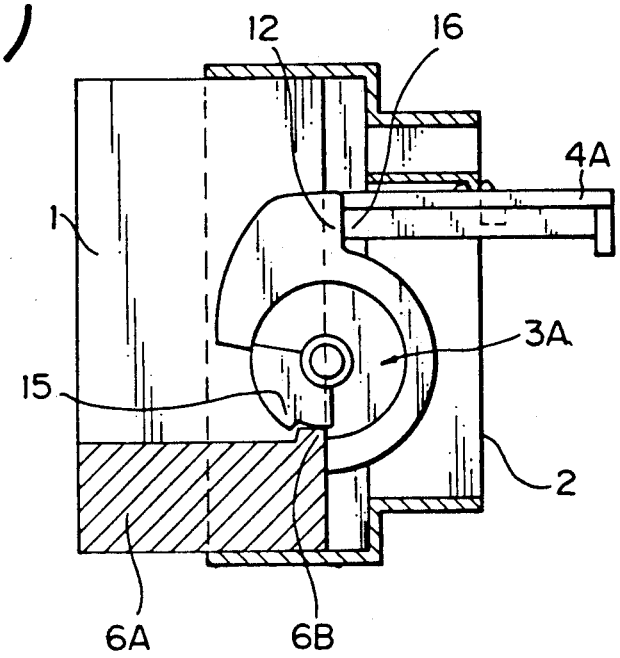
FIGS. 6(A) to 6(C) are front views showing a state in which the embodiment shown in FIG. 5 is being operated.
Figure 6B:
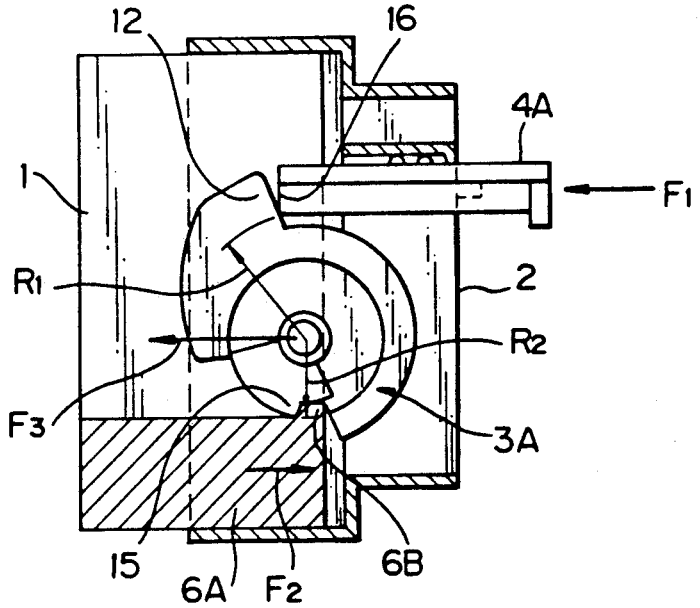
Figure 6C:
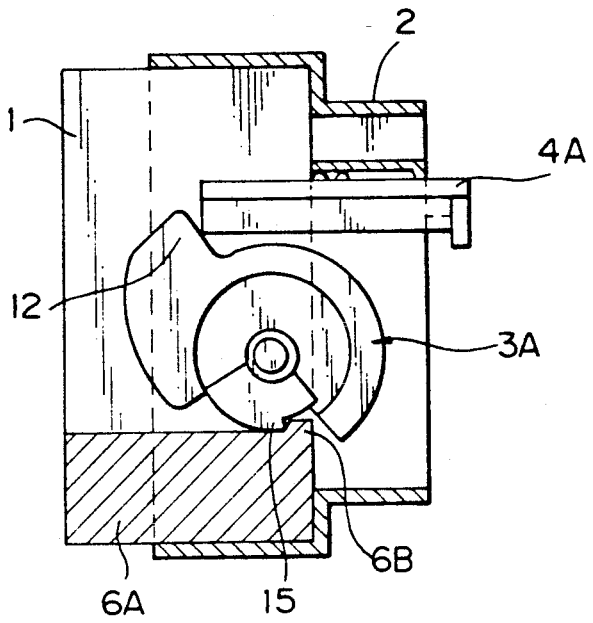
Figure 7:
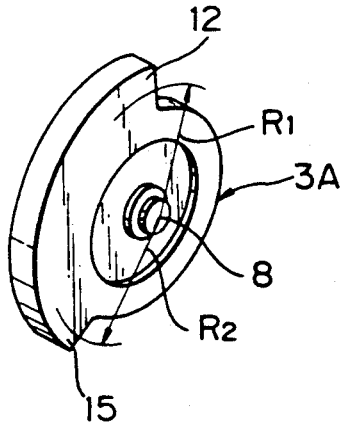
FIG. 7 is a perspective view of a rotatable cam used in a fifth embodiment according to the present invention.

Referring to FIGS. 5 to 7, fourth and fifth embodiments of the present invention will be described.

Referring to FIGS. 5 showing the fourth embodiment, in a multi-way connector in which the front half portions of a female connector housing 1 accommodating groups of female terminals (not shown) and a male connector housing 2 accommodating groups of male terminals (not shown) are fitted in each other so as to be coupled together, a disc-like rotatable cam 3A having a driver point projection 12 and a follower point pawl 15 formed on the outer circumference thereof is rotatable supported in a cavity portion 19 of the male connector housing 2, and a driver slide 4A is provided above the rotatable cam 3A such that it slides in the coupling direction (as indicated by arrow A) of the connector housing. In this construction, the leading end 16 of the driver slide 4A is brought into abutment with the rear of the driver point projection 12, while the rear end 4B of the same driver slide 4A is allowed to slightly project from the rear wall 10 of the connector housing.

A follower base portion 6A that is situated underneath the rotatable cam 3A when the female and male connector housings are coupled together is formed at a lower position in a central cavity portion 19 of the female connector housing 1, and the upper portion of the leading end of the follower base portion 6A is formed into a follower engagement portion 6B projecting in such a manner as to be brought into engagement with the follower point pawl 15.

These rotatable cam 3A and follower engagement portion 6B are arranged in the respective connector housings such that they look out upon the front opening portions of the confronting connector housings.

Figure 5C:
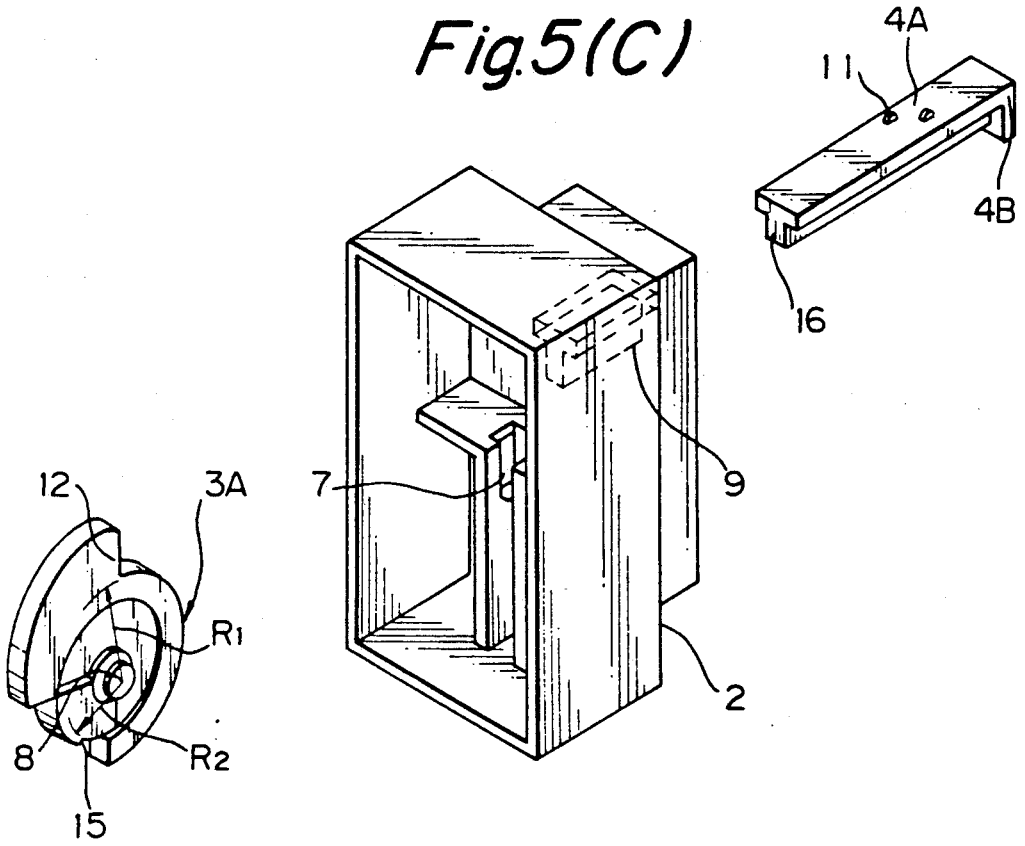

To specifically describe, referring to FIG. 5(C), the rotatable cam 3A and the driver slide 4A are individual bodies and are formed from resin. The rotatable cam 3A is formed into a plate-like shape and has at the center thereof a support shaft 8 projecting therefrom, and this support shaft 8 is rotatably supported on a support portion 7 provided in the central cavity portion 19 of the male connector housing 2 in such a manner that the axis thereof intersects the coupling direction A at right angles.

The driver point projection 12 having a rotative radius $R_1$ and the follower point pawl 15 having a rotative radius $R_2$ are formed on the outer circumference of the rotatable cam 3A in such a manner as to project therefrom with a rotative radius structure of $R_1 \geqq R_2$ being set between the two radii. In this construction, when the leading end 16 of the driver slide 4A is brought into abutment with the rear of the driver point projection 12, the rotatable cam 3A is actuated to rotate through a predetermined angle, and this brings the follower point pawl 15 into engagement with the rear of the follower engagement portion 6B of the female connector housing 1 that is in a temporary coupled state [as shown in FIG. 6(A)]. In this way, the follower base portion 6A of the female connector housing 1 is drawn nearer and slides by a distance equal to a predetermined stroke as the rotatable cam 3A is rotated.

The driver slide 4A is inserted into a slide groove 9 formed in an upper position in the cavity portion 19 of the male connector housing 2 from the rear in such a manner as to slide in the same direction as the coupling direction A of the connector housing, and small locking projections 11 are provided on the top slide of the driver slide 4A so that the driver slide 4A may be locked in its front dead point once it reaches the same dead point.

Referring to FIG. 6, in a semi-coupled state in which the female and male connector housings 1, 2 are confronted to and slightly fitted in each other [in a state in which the terminals in the respective connector housings are not connected to each other as shown in FIG. 6(A)], when the leading end 16 of the driver slide 4A is brought into abutment with the rear of the driver point projection 12 of the rotatable cam 3A, the follower point pawl 15 of the rotatable cam 3A is then brought into mesh engagement with the follower engagement portion 6B of the follower base portion 6A of the female connector housing 1. Following this, when the rear end 4B of the driver slide 4A continues to be pushed in by the tip of the finger or the like, the driver slide 4A further pushes the rotatable cam 3A so as to further rotate the same, and the follower base portion 6A is drawn nearer towards the male connector housing 1 as the follower point pawl 15 further rotates, while the rotatable cam 3A itself is caused to move to reduce a distance relative to the female connector housing 1, whereby the female and male connector housings 1, 2 are caused to continue to approach each other until, as shown in FIG. 6(C), the driver slide 4A reaches its front dead point, where the two connector housings are coupled together in a normal posture for connection.

In the above embodiment of the multi-way connector shown in FIG. 5, during the above coupling operation, when pushing-in force $F_1$ generated by the driver slide 4A is applied to the driver point projection 12 having the rotative radius $R_1$, the rotatable cam 3A is started to rotate with a torque of $R_1 \times F_1$, and transmits the torque to the follower point pawl 15 having the rotative radius $R_2$ as a torque of $R_2 \times F_2$, while it moves relatively to the follower base portion 6A to reduce the distance therebetween. In this construction, as shown in FIG. 6(D), the rotatable cam 3A, the driver slide 4A, and the follower base portion 6A function as a movable pulley A with a single rope wound therearound, a portion C of the rope wound around the movable pulley A that is on the take-up side, and portion B of the rope wound around the movable pulley A that is on the fixed end side, respectively. Due to this, drawing force $F_2$ generated on the follower base portion 6A is amplified to a force expressed by an equation of $F_2 = R_1/R_2 \times F_1$ relative to pushing-in force $F_1$ generated by the driver slide 4A, and a force expressed by and equation of $F_3 = F_1 + F_2 = F_1(1 + R_1/R_2)$ is generated on the rotatable cam 3A. Since the above radius ratio relationship of $R_1 \geqq R_2$ exists between $R_1$ and $R_2$, the female and male connector housings 1, 2 are coupled together for connection with a great magnitude of coupling force $F_3$.

FIG. 7 shows a rotatable cam 3A according to the fifth embodiment of the present invention. In this rotatable cam 3A, the radius ratio relationship is set such that $R_1$ equals $R_2$. According to this embodiment, the coupling force $F_3$ acting on the pair of connector housings 1, 2 is expressed by an equation of $F_3=2F_1$ relative to the pushing-in force $F_1$, and thus this fifth embodiment serves to generate the coupling force that doubles the pushing-in force generated by the tip of the finger.

Moreover, in the multi-way connectors shown in FIGS. 5 and 7, the connector housings are constructed such as to be coupled together for connection only by pushing in the driver slide 4A projecting rearwardly of the connector housing in the coupling direction of the connector housing, the connector housings are able to snap into place in a simple and accurate manner only with the tip of the finger of one of the hands, and no special operation space is required. Thus, the multi-way connectors according to the relevant embodiments serve to improve the operating efficiency required for a multi-way connector for use in automotive vehicles in which a simple and accurate coupling operation needs to be carried out in a limited space.

In addition, since the coupling operation efficiency and less inserting force coupling are attained by using the cam mechanism mainly comprising the rotatable cam 3A and the driver slide 4A, the rotatable cam 3A may, for instance, be a thin disc-like cam, provided that it serves well enough to transmit the above-mentioned torques, and this makes the cam mechanism substantially smaller, avoiding any possibility in which connector housings are made larger. Thus, the cam mechanism according to the present invention has the following practical advantages: it meets the industrial requirements for smaller connectors; it is simple in construction and easy to be formed when compared to a conventional gear mechanism; it is produced at lower costs; and it operates accurately.

As described above, the multi-way connector requiring less inserting force according to the present invention has the following advantages: it does not require the operator to shift his/her hand from one to another as in the case of a conventional multi-way connector; it is coupled for connection in a simple and accurate manner; it obviates the necessity of special space for coupling operation there-around and offers superior connecting operation efficiency, whereby the operating efficiency with which multi-way connectors are coupled together for connection in wire harness formation lines, automotive vehicle assembly lines, and in the service and inspection of automotive vehicles is improved; it accomplishes these advantages while meeting the industrial requirements for smaller and lighter connectors without any possibility in which connectors are made larger; and it is simple in construction and easy to use.

What is claimed is:

1. A multi-way connector requiring less inserting force in which the front portions of a pair of female and male connector housings each accommodating groups of terminals are fitted in each other so as to be coupled together for connection, wherein:

a rotatable cam rotatably supported and having a driver point projection and a follower point pawl that are formed on the outer circumference thereof is provided in one of said pair of connector housings, while a driver slide is mounted on the upper side of said rotatable cam, said driver slide being slidable in a coupling direction of said one of said pair of connector housings, a leading end of said driver slide being brought into abutment with the rear of said driver point projection, and a rear end thereof being allowed to project from said one of said pair of connector housings; and that a follower engagement portion designed to be brought into engagement with said follower point pawl is provided in the other connector housing of said pair of connector housings, while a radius ratio relationship between the rotative radius of said driver point projection and said follower point pawl is set such that the former becomes equal to or greater than the latter, whereby said pair of connector housings are coupled together for connection by the action of said rotatable cam resulting when said driver slide is pushed in.

2. A multi-way connector requiring less inserting force according to claim 1 in which the front portions of a pair of female and male connector housings each accommodating groups of terminals are fitted in each other so as to be coupled together for connection, wherein:

a pinion rotatable supported and a slide rack are provided in one of said pair of connector housings, said slide rack being in mesh with said pinion and slidable in a coupling direction of said one of said pair of connector housings, and a rear end of said slide rack being allowed to project from said one of said pair of connector housings; and wherein a fixed rack portion is provided in the other connector housing of said pair of connector housings, said fixed rack portion being in mesh with said pinion and allowing said pinion to roll thereon, whereby said pair of connector housings are coupled together for connection by sliding said slide rack.

3. A multi-way connector requiring less inserting force according to claim 2, wherein a pinion is provided which comprises a large diameter pinion portion and a small diameter pinion portion which share a rotating shaft so as to integrally rotate, said large diameter pinion portion being mesh with said slide rack, and said small diameter pinion portion being mesh with said fixed rack portion.

4. A multi-way connector requiring less inserting force according to claim 2, wherein a positioning projection is formed on the outer circumference of said pinion, said positioning projection being brought into abutment with the leading end of said slide rack when said slide rack is situated at a rear dead point.

5. A multi-way connector requiring less inserting force according to claim 2, wherein helical gears are provided on said pinion and said two racks.

6. The connector of claim 1 wherein a slide groove is formed in an upper position in the cavity portion of said one of the connector housings, said driver slide is slidably engaged in said slide groove, and said drive slide is provided with a locking projection adapted to temporarily hold said slide in a front dead point position when said slide reaches said position.

* * * * *